US007028587B1

(12) United States Patent
Chiang

(10) Patent No.: US 7,028,587 B1
(45) Date of Patent: Apr. 18, 2006

(54) RATCHET TOOL

(76) Inventor: Shu Chi Chiang, No. 33-20, Lane 230, Sec. 1, Satien Road, Dadu Hsiang, Taichung 43247 (TW)

( * ) Notice: Subject to any disclaimer, the term of this patent is extended or adjusted under 35 U.S.C. 154(b) by 46 days.

(21) Appl. No.: 11/182,418

(22) Filed: Jul. 15, 2005

(51) Int. Cl.
*B25B 13/46* (2006.01)

(52) U.S. Cl. ..... 81/63.1; 81/63; 81/62

(58) Field of Classification Search ..... 81/63.1, 81/63.2, 63; 408/122, 123, 120; 470/184
See application file for complete search history.

(56) References Cited

U.S. PATENT DOCUMENTS 5,974,915 A * 11/1999 Chou ..... 81/63.1
6,070,503 A * 6/2000 Shiao ..... 81/63.2
6,227,077 B1 5/2001 Chiang
6,250,183 B1 6/2001 Chiang
6,260,446 B1 * 7/2001 Hu ..... 81/62
6,393,949 B1 * 5/2002 Ho ..... 81/62
6,644,147 B1 * 11/2003 Huang ..... 81/62
6,722,448 B1 * 4/2004 Ju ..... 173/109
6,935,211 B1 * 8/2005 Chen ..... 81/58.4

* cited by examiner

*Primary Examiner*—Lee D. Wilson
*Assistant Examiner*—Alvin J. Grant

(57) ABSTRACT

A ratchet tool comprising a handle, a cartridge attached to the handle, a barrel rotatably received in the cartridge and having a gear and having a non-circular engaging hole, and one or more driving stems each having a non-circular end segment selectively engaged with the engaging hole of the barrel, for allowing the driving stems to be selectively rotated by the barrel. Two pawls are slidably received in the cartridge and each has one or more teeth biased to selectively engage with the gear of the barrel, and a control ferrule includes an actuator for selectively disengaging the teeth of the pawls from the gear of the barrel, to control the driving direction of the barrel and the driving stem.

6 Claims, 6 Drawing Sheets

RATCHET TOOL

BACKGROUND OF THE INVENTION

1. Field of the Invention

The present invention relates to a ratchet tool, and more particularly to a ratchet tool having a simplified configuration for engaging with and for driving various tool members or fasteners with changeable driving stems.

2. Description of the Prior Art

Typical ratchet tools comprise a gear rotatably received in a housing or an insert, and a pair of pawls biased by spring members to engage with the gear and to be selectively disengaged from the pawls by a control member. However, normally, an additional control member is required for actuating and disengaging the pawls from the gear. In addition, the pawls may not be stably retained in place.

In order to solve the problems, the applicant has developed various kinds of ratchet tools, and some of the ratchet tools have been allowed and issued as U.S. Pat. No. 6,227,077 to Chiang, and U.S. Pat. No. 6,250,183 to Chiang. The ratchet tools comprise a pair of pawls slidably received in a housing or cartridge, and a control ferrule engaged onto the housing or cartridge, and engaged with the pawls for causing or forcing the pawls to engage with a driving stem, in order to control the driving direction of the driving stem.

However, the driving stem is rotatably attached or secured to the housing or cartridge, and may not be disengaged from the housing or cartridge, such that the other driving stems may not be selectively or changeably attached or secured to the housing or cartridge for driving different fasteners or the like.

The present invention has arisen to mitigate and/or obviate the afore-described disadvantages of the conventional ratchet mechanisms for driving tools.

SUMMARY OF THE INVENTION

The primary objective of the present invention is to provide a ratchet tool including a simplified configuration for engaging with and for driving various tool members or fasteners with changeable driving stems.

In accordance with one aspect of the invention, there is provided a ratchet tool comprising a handle including a first end, a cartridge including a first end engaged into the first end of the handle and rotated in concert with the handle, the cartridge including an orifice formed therein, and including a pair of apertures formed therein and communicating with the orifice thereof, a barrel including a first end rotatably received in the orifice of the cartridge and having a gear formed thereon, the barrel including an opening and a non-circular engaging hole formed therein, a driving stem including an end segment engageable into the opening of the barrel, and having a non-circular cross section for engaging with the corresponding non-circular engaging hole of the barrel, and for allowing the driving stem to be rotated by the barrel, a pair of pawls slidably received in the apertures of the cartridge respectively and each including at least one tooth formed thereon, the pawls each including a recess formed therein for receiving the barrel, a spring biasing device for biasing the tooth of the pawls to selectively engage with the gear of the barrel, a control ferrule rotatably engaged on the cartridge, the control ferrule including an actuator extended radially inward therefrom, for engaging with the pawls and for selectively disengaging the tooth of the pawls from the gear of the barrel, to control driving direction of the barrel and the driving stem, the control ferrule including two depressions formed therein for defining the actuator, the depressions of the control ferrule being provided for selectively receiving the pawls and for allowing the tooth of the pawls to be biased to engage with the gear of the barrel, the control ferrule including three cavities formed therein, and a spring-biased projection received in the cartridge and selectively engaging with either of the cavities of the control ferrule, to position the control ferrule to the cartridge at selected angular position.

The barrel includes a narrowed peripheral shoulder formed therein, the control ferrule includes an annular flange extended radially inward therefrom and engaged with the cartridge and engaged with the narrowed peripheral shoulder of the barrel, for rotatably coupling the barrel to the cartridge.

The control ferrule includes a curved slot formed therein, and the cartridge includes a peg extended therefrom and slidably engaged into the curved slot of the control ferrule, for guiding the control ferrule to rotate relative to the cartridge.

A cap may further be provided and engaged onto the driving stem, and engaged onto the control ferrule and engaged with the narrowed peripheral shoulder of the barrel, for rotatably coupling the control ferrule and the barrel together.

The cartridge includes a passage formed therein, the barrel includes a tail rotatably engaged in the passage of the cartridge, and includes an annular groove formed therein, a catch is engaged into the cartridge and engaged into the annular groove of the barrel, for rotatably securing the barrel to the cartridge.

The pawls each includes at least one second tooth formed thereon, and the second tooth of the pawls are selectively biased to engage with the gear of the driving stem when the pawls are changed to a different position relative to the cartridge.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
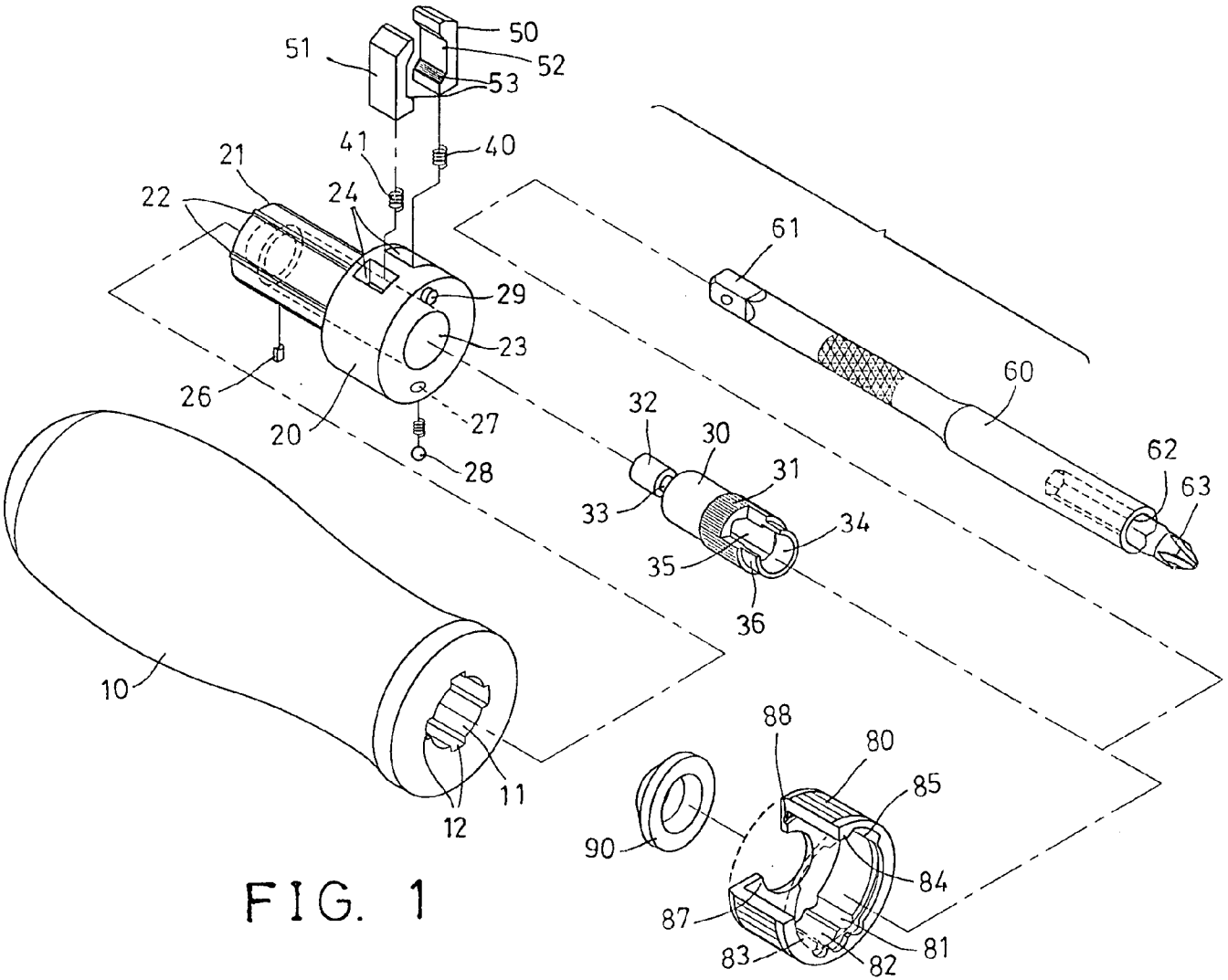
FIG. 1 is an exploded view of a ratchet tool in accordance with the present invention.
Figure 2:
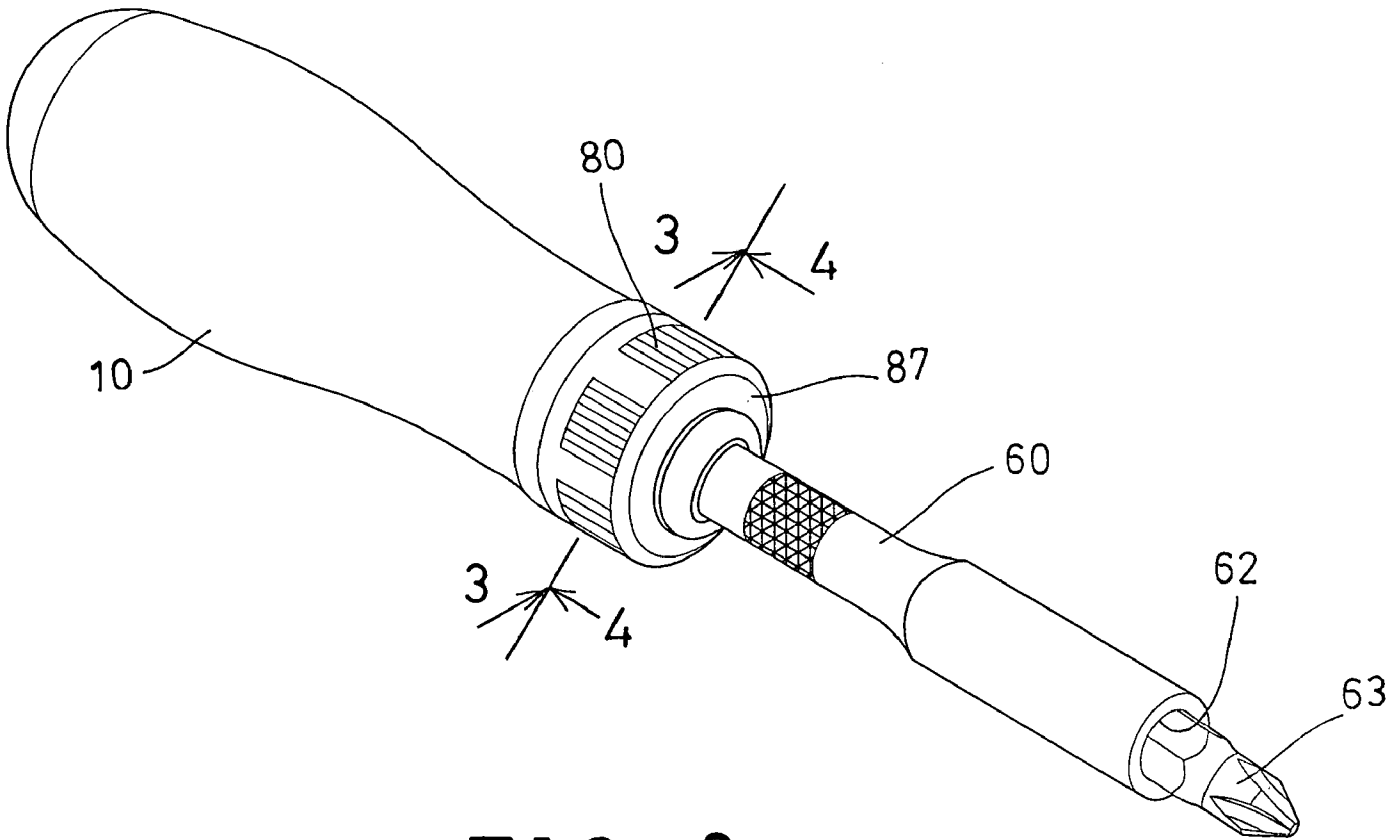
FIG. 2 is a perspective view of the ratchet tool.

Referring to FIGS. 1–4, a ratchet tool in accordance with the present invention comprises a handle 10 including a bore 11 and one or more channels 12 formed in one end thereof and communicating with each other. A cartridge 20 includes a stud 21 extended from one end thereof and engaged into the bore 11 of the handle 10 and includes one or more projections or protrusions 22 extended from the stud 21 for engaging with the channels 12 of the handle 10 and for securing the cartridge 20 to the handle 10 and for preventing the cartridge 20 from rotating relative to the handle 10.

The cartridge 20 includes an orifice 23 formed therein for rotatably receiving a barrel 30 therein, and includes a pair of blind holes or apertures 24 formed in the cartridge 20 and substantially perpendicular to the cartridge 20, and intersecting and communicating with the orifice 23 thereof. Two spring members 40, 41 and two pawls 50, 51 are slidably received in the apertures 24 of the cartridge 20 respectively. The pawls 50, 51 each includes a recess 52 formed in the middle portion thereof for receiving the barrel 30, particularly for receiving the gear 31 that is formed or provided on the outer peripheral portion and on the middle portion of the barrel 30.

Figure 4:
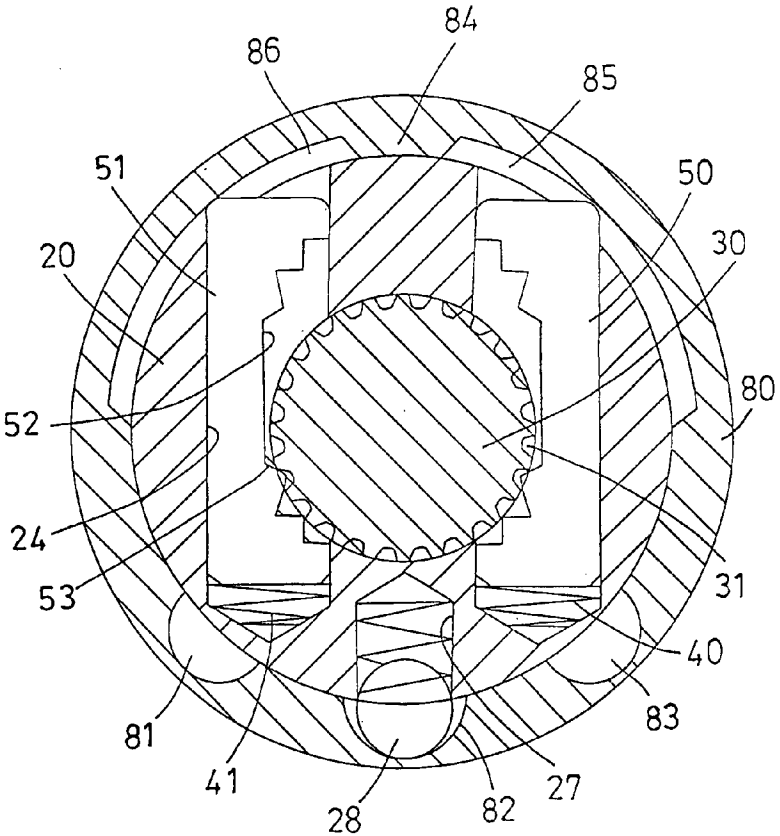
FIG. 4 is a cross sectional view of the ratchet tool, taken along lines 4—4 of FIG. 2.
Figure 5:
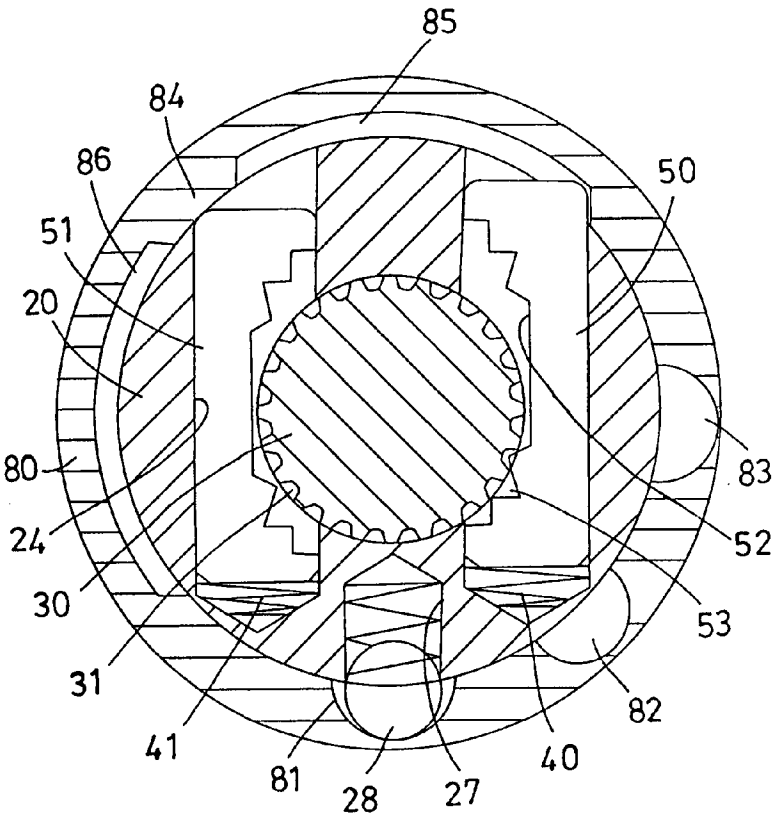
FIG. 5 is a cross sectional view similar to FIG. 4, illustrating the operation of the ratchet tool.

The pawls 50, 51 each includes one or both ends each having one or more teeth 53 formed or provided thereon, such as extended into each end of the recess 52 thereof, for selectively engaging with the gear 31 of the barrel 30. The spring members 40, 41 may bias the teeth 53 in one end of the pawls 50, 51 to engage with the gear 31 (FIGS. 4, 5). When the teeth 53 in one end of the pawls 50, 51 have been worn out, the pawls 50, 51 may be changed to different direction for allowing the teeth 53 on the other ends of the pawls 50, 51 to be arranged and biased to engage with the gear 31 of the barrel 30 by the spring members 40, 41 respectively.

Figure 3:
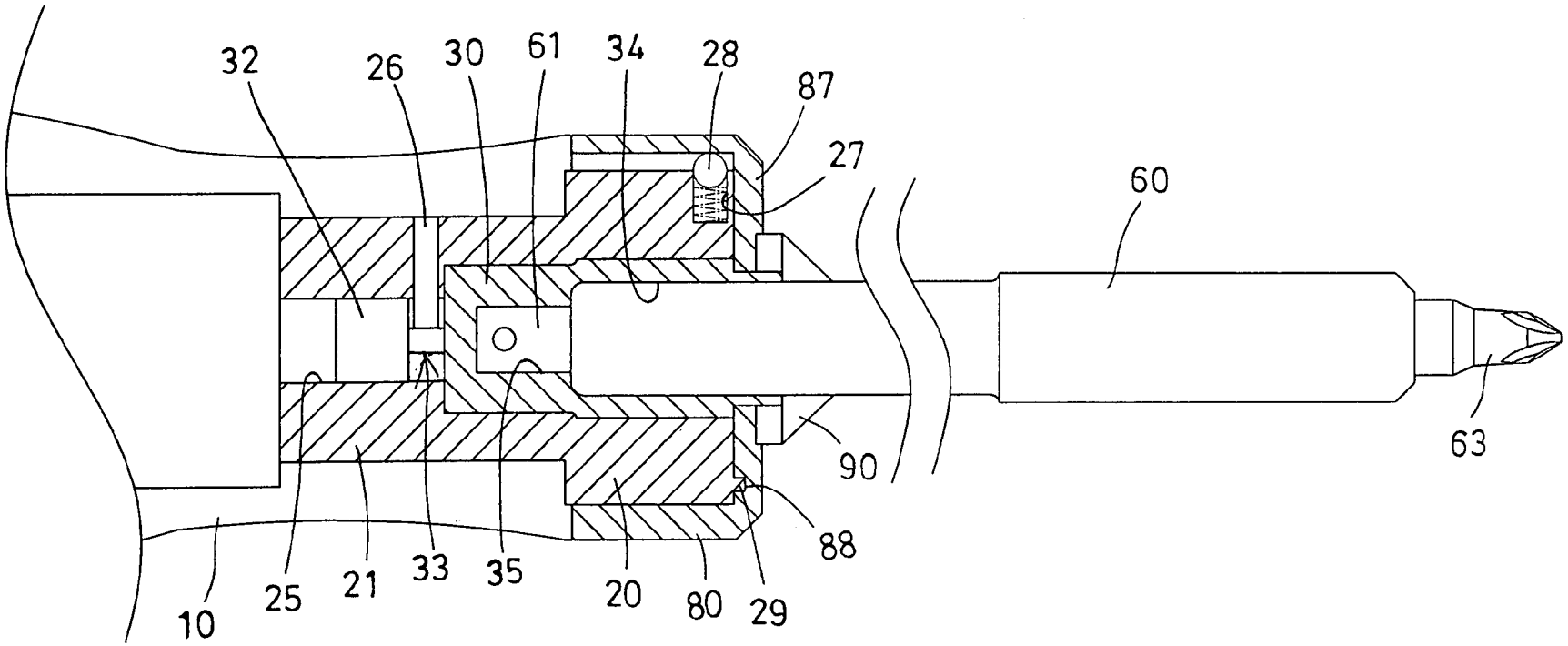
FIG. 3 is a partial cross sectional view of the ratchet tool, taken along lines 3—3 of FIG. 2.

The cartridge 20 includes a narrower passage 25 formed therein, such as formed in the inner or rear end thereof, or formed in the stud 21 thereof, best shown in FIG. 3. The barrel 30 includes a narrower tail 32 formed or extended from one end thereof, and rotatably engaged in the narrower passage 25 of the cartridge 20, and includes an annular groove 33 formed therein. A catch 26 is engaged through or into the cartridge 20 and engaged into the annular groove 32 of the barrel 30, for rotatably securing the barrel 30 to the cartridge 20 and for preventing the barrel 30 from sliding relative to the cartridge 20, and for preventing the gear 31 of the barrel 30 from being disengaged from the pawls 50, 51.

The barrel 30 includes an opening 34 formed in one end thereof for receiving a driving stem 60 therein, and includes a non-circular engaging hole 35 formed in the inner portion thereof for receiving an end segment 61 of the driving stem 60 which also includes a non-circular cross section, for engaging with the corresponding non-circular engaging hole 35 of the barrel 30, and thus for allowing the driving stem 60 to be rotated or driven by the barrel 30. The barrel 30 further includes a narrowed peripheral shoulder 36 formed in the one end thereof. The driving stem 60 includes an engaging hole 62 formed in one end thereof for receiving a fastener, a tool extension or other tool bits 63.

A control ferrule 80 is rotatably engaged onto the cartridge 20 and includes an inner peripheral portion having three cavities 81, 82, 83 formed therein. The cartridge 20 includes a cavity 27 formed therein for receiving a spring-biased projection 28 which may be biased to engage with either of the three cavities 81, 82, 83 of the control ferrule 80, best shown in FIGS. 4, 5, for positioning the control ferrule 80 to the cartridge 20 at selected angular positions, and for maintaining the engagements or the disengagements of the teeth 53 of the pawls 50, 51 with or from the gear 31 of the barrel 30.

The control ferrule 80 further includes a bulge or an actuator 84 extended radially inward from the inner peripheral portion thereof and preferably defined between two separate depressions 85, 86, for selectively engaging with either of the pawls 50, 51 and for selectively disengaging the teeth 53 of the pawls 50, 51 from the gear 31 of the barrel 30 (FIG. 5). The control ferrule 80 includes an annular flange 87 extended radially inward therefrom and engaged with the cartridge 20 and engaged with the narrowed peripheral shoulder 36 of the barrel 30, for rotatably retaining or coupling the barrel 30 to the cartridge 20.

A cap 90 is engaged onto the driving stem 60, and also engaged onto the control ferrule 80 and engaged with the narrowed peripheral shoulder 36 of the barrel 30, and may be secured to the barrel 30 with such as force-fitted engagements, adhesive materials, fasteners (not shown), or by welding processes, in order to rotatably secure or couple the control ferrule 80 and the barrel 30 together, and for preventing the control ferrule 80 from being disengaged from the barrel 30 and the cartridge 20. It is preferable that the control ferrule 80 includes a curved slot 88 formed therein (FIGS. 1, 6), and the cartridge 20 includes a peg 29 extended therefrom, for slidably engaging into the curved slot 88 of the control ferrule 80, and for smoothly guiding the control ferrule 80 to rotate relative to the cartridge 20.

In operation, as shown in FIG. 4, when the actuator 84 of the control ferrule 80 is disengaged from the pawls 50, 51, the pawls 50, 51 may be received in the depressions 85, 86 of the control ferrule 80 respectively, and the teeth 53 of the pawls 50, 51 may be biased to engage with the gear 31 of the barrel 30, such that the gear 31 and thus the barrel 30 may be driven to rotate in both directions by the handle 10 via the cartridge 20 and the barrel 30.

As shown in FIG. 5, when the control ferrule 80 is rotated in one direction to actuate the actuator 84 thereof to engage with and thus to force and to move the pawl 51 against the spring member 41 and to disengage the teeth 53 of the pawl 51 from the gear 31 of the barrel 30, the gear 31 of barrel 30 and thus the driving stem 60 may be driven to rotate in one direction, such as the counterclockwise direction by the handle 10 via the cartridge 20, but may not be rotated in the other direction, such as the clockwise direction by the handle 10.

On the contrary, when the control ferrule 80 is rotated in the reverse direction to cause the actuator 84 thereof to disengage the teeth 53 of the other pawl 50 from the gear 31 of the barrel 30, the barrel 30 may be driven to rotate in the other direction, such as the clockwise direction by the handle 10 via the cartridge 20, but may not be rotated in the one direction, such as the counterclockwise direction by the handle 10.

It is to be noted that various driving stems 60 may be selected and may have their end segments 61 selectively engaged into the non-circular engaging hole 35 of the barrel 30, for allowing the driving stems 60 to be changeably or selectively rotated or driven by the barrel 30, and thus for allowing the driving stems 60 to rotate or to drive various tool members or fasteners with the driving stems that may be changed from each other.

Figure 6:
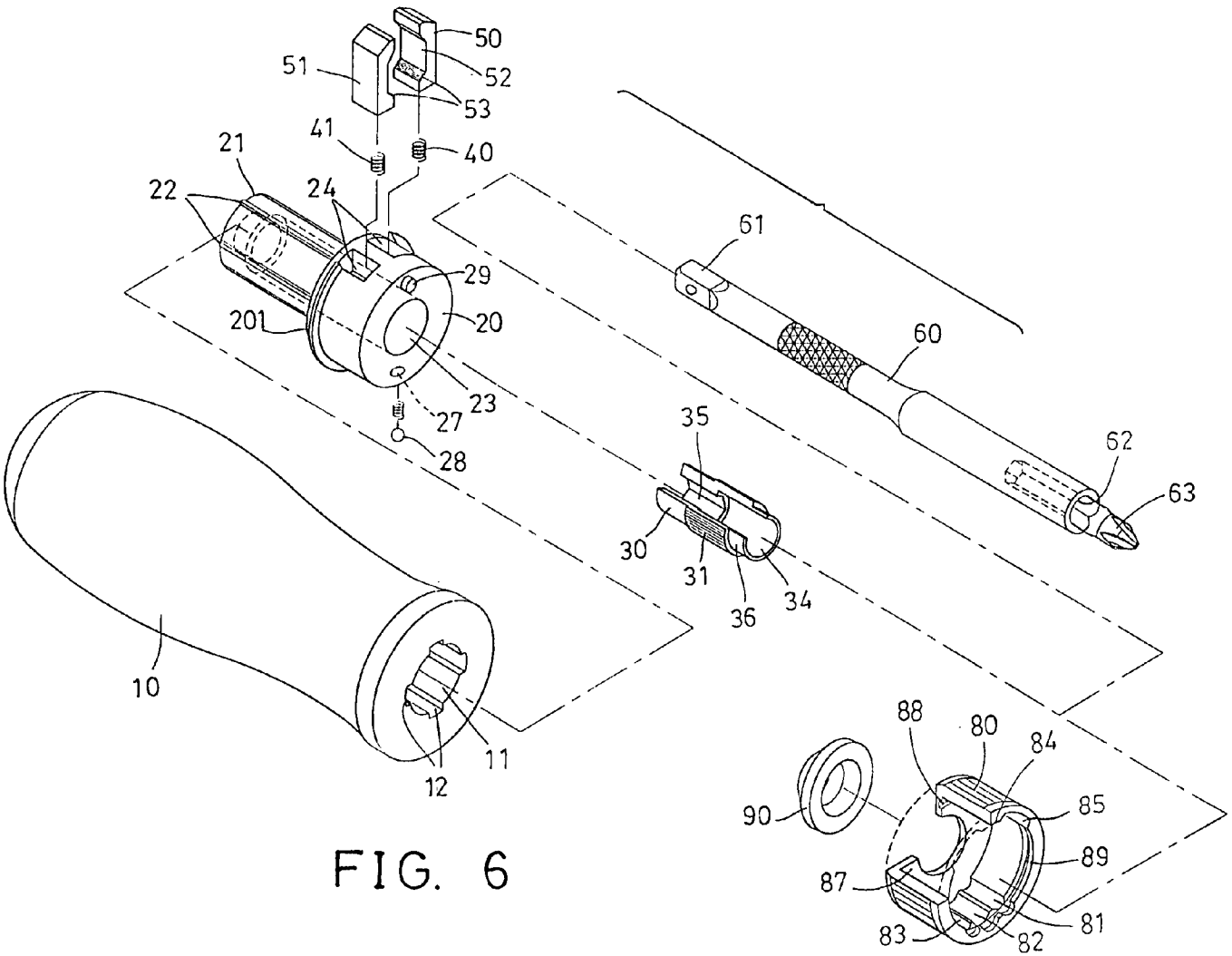
FIG. 6 is an exploded view similar to FIG. 1, illustrating the other arrangement of the ratchet tool.
Figure 7:
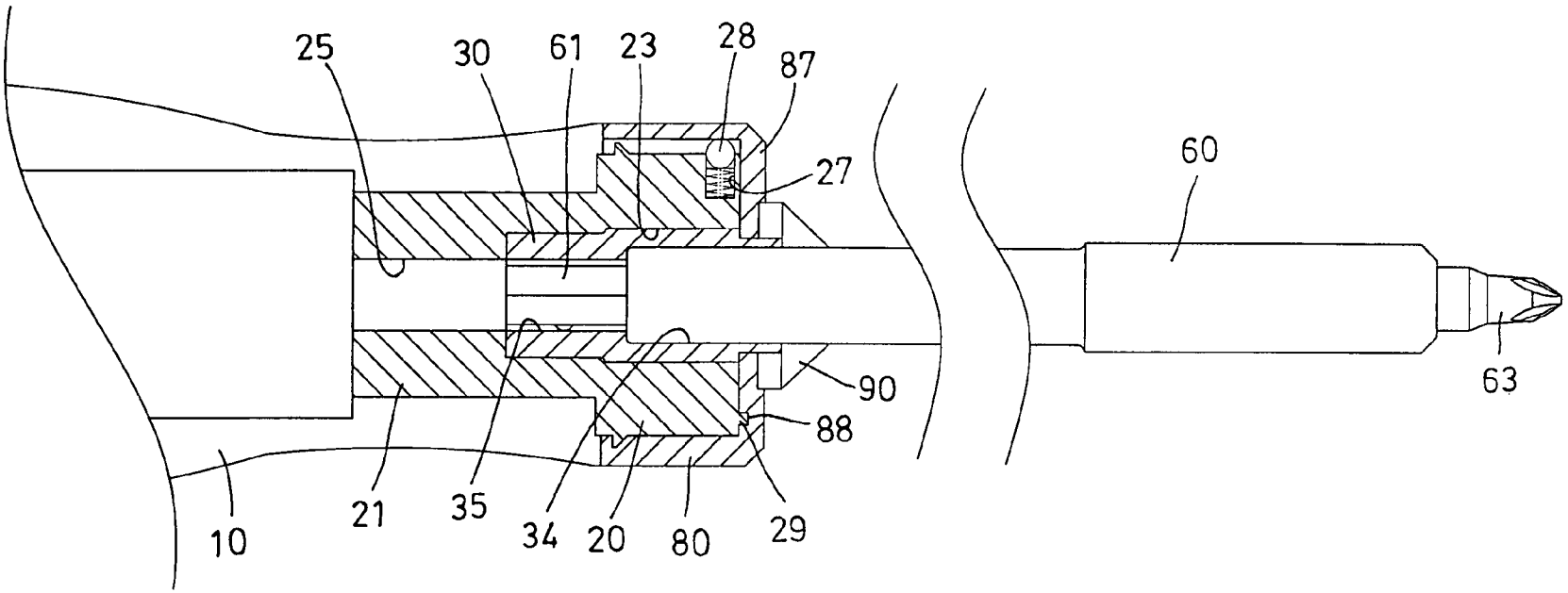
FIG. 7 is a partial cross sectional view of the ratchet tool as shown in FIG. 6.

Referring next to FIGS. 6 and 7, alternatively, without the catch 26 and the narrower tail 32 and the annular groove 33 of the barrel 30, the barrel 30 may also be rotatably received and retained within the orifice 23 of the cartridge 20 by the control ferrule 80 and the cap 90. The cartridge may include an annular swelling 201 formed or provided on the outer peripheral portion thereof, and the control ferrule may include an annular peripheral groove 89 formed therein, for engaging with the annular swelling 201 of the cartridge, and for rotatably securing the control ferrule to the cartridge.

Accordingly, the ratchet tool in accordance with the present invention includes a simplified configuration for engaging with and for driving various tool members or fasteners with changeable driving stems.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a handle including a first end, a cartridge including a first end engaged into said first end of said handle and rotated in concert with said handle, said cartridge including an orifice formed therein, and including a pair of apertures formed therein and communicating with said orifice thereof, a barrel including a first end rotatably received in said orifice of said cartridge and having a gear formed thereon, said barrel including an opening and a non-circular engaging hole formed therein, a driving stem including an end segment engageable into said opening of said barrel, and having a non-circular cross section for engaging with said corresponding non-circular engaging hole of said barrel, and for allowing said driving stem to be rotated by said barrel, a pair of pawls slidably received in said apertures of said cartridge respectively and each including at least one tooth formed thereon, said pawls each including a recess formed therein for receiving said barrel, means for biasing said at least one tooth of said pawls to selectively engage with said gear of said barrel, a control ferrule rotatably engaged on said cartridge, said control ferrule including an actuator extended radially inward therefrom, for engaging with said pawls and for selectively disengaging said at least one tooth of said pawls from said gear of said barrel, to control driving direction of said barrel and said driving stem, said control ferrule including two depressions formed therein for defining said actuator, said depressions of said control ferrule being provided for selectively receiving said pawls and for allowing said at least one tooth of said pawls to be biased to engage with said gear of said barrel, said control ferrule including three cavities formed therein, and a spring-biased projection received in said cartridge and selectively engaging with either of said cavities of said control ferrule, to position said control ferrule to said cartridge at selected angular position.

2. The ratchet tool as claimed in claim 1, wherein said barrel includes a narrowed peripheral shoulder formed therein, said control ferrule includes an annular flange extended radially inward therefrom and engaged with said cartridge and engaged with said narrowed peripheral shoulder of said barrel, for rotatably coupling said barrel to said cartridge.

3. The ratchet tool as claimed in claim 1, wherein said control ferrule includes a curved slot formed therein, and said cartridge includes a peg extended therefrom and slidably engaged into said curved slot of said control ferrule, for guiding said control ferrule to rotate relative to said cartridge.

4. The ratchet tool as claimed in claim 1 further comprising a cap engaged onto said driving stem, and engaged onto said control ferrule and engaged with said narrowed peripheral shoulder of said barrel, for rotatably coupling said control ferrule and said barrel together.

5. The ratchet tool as claimed in claim 1, wherein said cartridge includes a passage formed therein, said barrel includes a tail rotatably engaged in said passage of said cartridge, and includes an annular groove formed therein, a catch is engaged into said cartridge and engaged into said annular groove of said barrel, for rotatably securing said barrel to said cartridge.

6. The ratchet tool as claimed in claim 1, wherein said pawls each includes at least one second tooth formed thereon, and said at least one second tooth of said pawls are selectively biased to engage with said gear of said driving stem when said pawls are changed to a different position relative to said cartridge.

* * * * *